US005809823A

United States Patent [19]

Blanck

[11] Patent Number: 5,809,823

[45] Date of Patent: Sep. 22, 1998

[54] METHOD AND APPARATUS FOR FEEDING A TUBULAR WORKPIECE INTO A DRAWING UNIT

[75] Inventor: Hans-Georg Blanck, Duisburg, Germany

[73] Assignee: Mannesmann Aktiengesellschaft, Düsseldorf, Germany

[21] Appl. No.: 920,014

[22] Filed: Aug. 26, 1997

[30] Foreign Application Priority Data

Sep. 6, 1996 [DE] Germany ..... 196 37 686.6

[51] Int. Cl.[6] ..... B21C 1/22; B21C 1/30

[52] U.S. Cl. ..... 72/291; 72/287; 72/285

[58] Field of Search ..... 72/291, 287, 289, 72/285, 282, 280

[56] References Cited

U.S. PATENT DOCUMENTS

| | | | |
|---|---|---|---|
| 400,238 | 3/1889 | McCool | 72/291 |
| 4,034,590 | 7/1977 | Shevakin | 72/280 |

FOREIGN PATENT DOCUMENTS

| | | | |
|---|---|---|---|
| 645 200 | 3/1995 | European Pat. Off. | 72/285 |
| 548 723 | 6/1995 | European Pat. Off. | 72/291 |
| 18089 | 9/1963 | Japan | 72/291 |

*Primary Examiner*—Daniel C. Crane
*Attorney, Agent, or Firm*—Cohen, Pontani, Lieberman & Pavane

[57] ABSTRACT

A method and apparatus for continuously feeding a generally tubular workpiece into a drawing unit of a continuous drawing machine without disadvantageously reducing the processing speed of the drawing machine. A workpiece having a reduced outer diameter drawing point is fed through a drawing ring by a pair of vertically stacked driving rollers until the drawing point extends beyond the drawing ring. The drawing point is then grabbed by a gripper and drawn through a drawing ring—its movement through the drawing ring still assisted by the driving rollers —to form a reduced diameter starting portion of the workpiece. In so doing, the workpiece is pulled along a drawing axis and in a drawing direction toward a drawing unit that defines a clamping length. Once the reduced diameter starting portion is formed, the gripper is swiveled away from the drawing axis and the drawing ring holder and drawing ring are caused to moved toward the drawing unit still aided by the drive rollers. The reduced diameter starting portion is then fed into the drawing unit, where the drawing unit then replaces the driving rollers and gripper as the means by which the workpiece is drawn through the drawing ring.

7 Claims, 1 Drawing Sheet

METHOD AND APPARATUS FOR FEEDING A TUBULAR WORKPIECE INTO A DRAWING UNIT

BACKGROUND OF THE INVENTION

1. Field of the Invention

The present invention is directed to a method and apparatus for feeding a generally tubular workpiece into a drawing unit and, more particularly, to a method and apparatus for reducing a portion of a tube or bar and feeding the reduced portion into a drawing unit of a continuous drawing machine thereby enabling continuous feeding of the workpiece through the drawing machine.

2. Description of the Related Art

In order to initiate the drawing process in a continuous drawing machine, it is typical in the prior art to steadily draw out the pointed beginning of the tube, also called the drawing point, in a plurality of steps until the actual drawing unit is capable of fully grasping the tube. For drawing machines having chain-type drawing units, this step-by-step drawing out process is carried out until the chains of the drawing unit are able to apply a sufficient drawing force to the tube to enable continuous feeding through the drawing unit. For example, European Patent Application 0645200 describes a device that reduces a first piece of the tube permitting the reduced first piece to be fed into and grasped by the revolving chains. However, the entire length of the chains must grasp the tube during the initial drawing. This process is disadvantageously time consuming and clearly limits the productive capacity of such continuous drawing machines.

Other known machines require auxiliary devices to initially draw-in the tube—such devices complicating the installation of the device, increasing its expense, and impeding its productive capacity.

Further known devices for feeding tubes into a drawing unit include at least two serially-arranged chain-type drawing machines and a gripper arranged behind each chain-type drawing machine for grasping the drawing point and pulling it into the drawing unit. The gripper is swivelable between a resting position that is lateral to and outside of the drawing direction, i.e. the direction of movement of the tube toward the drawing unit, and a working position. The drawing point of the tubes fed by such known devices is movable in the drawing direction between the driving chains of the chain-type drawing machines which circulate radially during operation.

SUMMARY OF THE INVENTION

It is accordingly an object of the present invention to provide a method and apparatus for threading or feeding the start of a generally tubular workpiece, preferably a tube or bar, into a drawing unit of a continuous drawing machine that substantially reduces the duration of the tube feeding cycle while only minimally reducing the drawing or production speed of the drawing machine. As used herein, the terms tube and bar are merely illustrative, non-limiting examples of possible workpieces processed according to the present invention. It will of course be obvious to a person skilled in the art that numerous other generally tubular workpieces such as, for example, rods, poles, pipes, cylinders, hoses, rails, shafts, etc., may be processed according to the present invention.

The apparatus of the present invention includes a drawing ring holder having a drawing ring mounted therein and a gripper carried on a gripper carriage. The drawing ring holder and gripper carriage are selectively movable along spaced apart parallel paths in a drawing direction and opposite thereto. A generally tubular workpiece, preferably a tube or bar, passes between two driving rollers that feed the workpiece in the drawing direction and into the drawing ring. The workpiece includes a tip section or drawing point that may be grasped by the gripper. The diameter of the workpiece is reduced as it passes through the drawing ring, the workpiece being moved in the drawing direction by the driving rollers and gripper. The narrowed portion of the tube may then be advantageously continuously fed into a drawing unit comprised of two vertically stacked revolving chains the define a clamping length.

The method of the present invention includes steps for:

positioning a drawing ring holder having a drawing ring mounted therein in an initial position at a distance from the drawing unit equal to the clamping length of the revolving chains; positioning a gripper carriage having a gripper arranged thereon in an initial position between the drawing ring and drawing unit in the drawing direction; feeding the drawing point of the workpiece through the drawing ring using drive rollers; closing the gripper on the drawing point thereby gripping the drawing point; forming a reduced diameter starting portion of the workpiece by moving the gripper in the drawing direction thereby drawing the workpiece through the drawing ring; opening the gripper and swiveling the gripper away from the drawing axis; feeding a portion of the reduced diameter starting portion into the drawing unit by moving the drawing ring holder, drawing ring and workpiece toward the drawing unit, the workpiece being carried in the drawing direction by the drawing ring holder and the drive rollers; and drawing the workpiece into the drawing unit using the revolving chains.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims.

BRIEF DESCRIPTION OF THE DRAWINGS

In the drawings, wherein like reference numerals denote similar elements throughout the several views.

DETAILED DESCRIPTION OF THE PRESENTLY PREFERRED EMBODIMENTS

Figure 1:
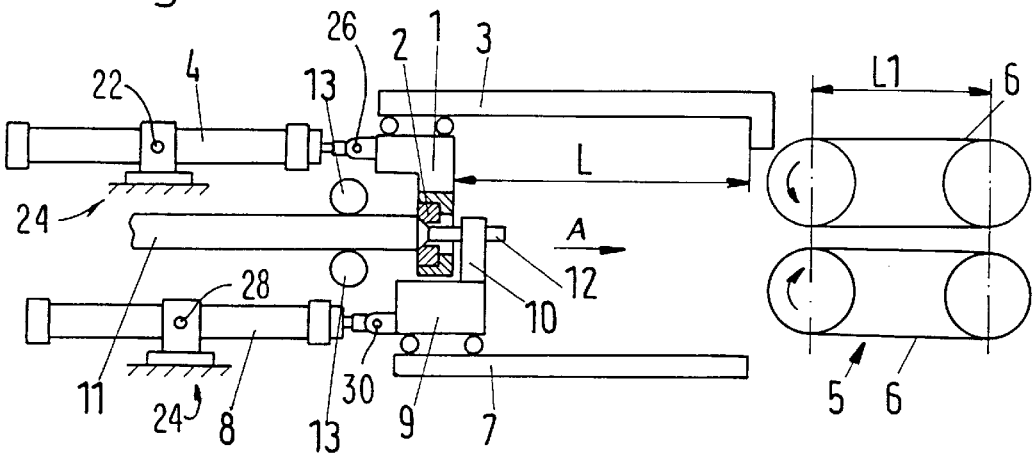
FIG. 1 depicts an apparatus for feeding a tube into a drawing unit of a continuous drawing machine configured according to the present invention, the apparatus including a gripper carried on a gripper carriage and a drawing ring mounted in a drawing ring holder, both deployed in a starting position.

The present invention provides a method and apparatus for continuously feeding a generally tubular workpiece into a drawing unit of a continuous drawing machine without disadvantageously reducing the processing speed of the drawing machine. A workpiece having a drawing point is fed through a drawing ring by a pair of vertically stacked driving rollers until the drawing point extends beyond the drawing ring. The drawing point is then grabbed by a gripper and the workpiece is drawn through a drawing ring—its movement through the drawing ring still assisted by the driving rollers—to form a reduced diameter starting portion of the workpiece. In so doing, the workpiece is pulled along a drawing axis and in a drawing direction toward a drawing unit that defines a clamping length. Once the reduced diameter starting portion is formed, the gripper is swiveled away from the drawing axis and the drawing ring holder and drawing ring are caused to moved toward the drawing unit still aided by the drive rollers. The reduced diameter starting portion is then fed into the drawing unit, where the drawing unit then replaces the driving rollers and gripper as the means by which the workpiece is drawn through the drawing ring.

As used herein, the terms tube and bar are merely illustrative, non-limiting examples of possible workpieces processed according to the present invention. It will of course be obvious to a person skilled in the art that numerous other generally tubular workpieces such as, for example, rods, poles, pipes, cylinders, hoses, rails, shafts, etc., may be processed according to the present invention.

Referring next to the drawings in detail, the present invention comprises a part of a continuous drawing machine. A tube or workpiece 11 is clamped between and longitudinally fed through a pair of drive rollers 13 that cause the tube 11 to move in a generally horizontal drawing direction indicated by arrow A and along a drawing axis. As the tube exits the driving rollers 13, it engages and contactingly passes through a drawing ring 2 mounted in a drawing ring holder 1—with the drawing ring 2 reducing the diameter of the tube 11 as the tube 11 is drawn therethrough. The drawing ring holder 1 and drawing ring 2 are linearly moveable along a guide 3 in the drawing direction over a maximum distance L. Linear movement of the drawing ring holder 1 and drawing ring 2 is effected by a first drive 4 preferably configured as a piston-cylinder unit. The first drive 4 is mounted at a first location 22 to a frame 24 that comprises a part of the continuous drawing machine and at a second location 26 to the drawing ring holder 1.

A gripper 10 is carried by a gripper carriage 9 for substantially linearly movement along a guide 7 in the drawing direction. A second drive 8, preferably configured as a piston-cylinder unit, effects movement of the gripper carriage 9 and gripper 10. The second drive 8 is mounted at a first location 28 to a frame 24 that comprises a part of the continuous drawing machine and at a second location 30 to the gripper carriage 9. The gripper 10 is swivelable away from the drawing axis, i.e. in a direction generally transverse to the drawing direction (see, e.g. FIG. 3), as desired.

The guides 3, 7 are arranged in substantially parallel spaced-apart relation to each other to permit substantially parallel movement therealong of the drawing ring holder 1 and gripper carriage 9, respectively.

A drawing unit 5 is provided as part of the continuous drawing machine and is preferably configured as two vertically stacked revolving chains 6 that define a clamping length L1. The chains 6 preferably revolve in opposite directions, i.e. clockwise and counter-clockwise, most preferably, the upper chain 6 revolving in a counter-clockwise direction and the lower chain 6 revolving in a clockwise direction. It will be obvious to one skilled in the art that the revolving chains 6 need not be vertically stacked for purposes of the present invention and that other relational disposition of the revolving chains 6 are considered by the inventing apparatus, provided, of course, that the chains 6 are disposed to draw a generally tubular workpiece therethrough.

The tube 11 includes at its front end a drawing point 12 that may be gripped by the gripper 10. As is depicted in FIG. 1, the drawing point 12 is fed through the drawing ring 2 and is grasped by the gripper 10.

The operation of the inventive apparatus will now be described with reference to FIGS. 1 to 3.

Figure 2:
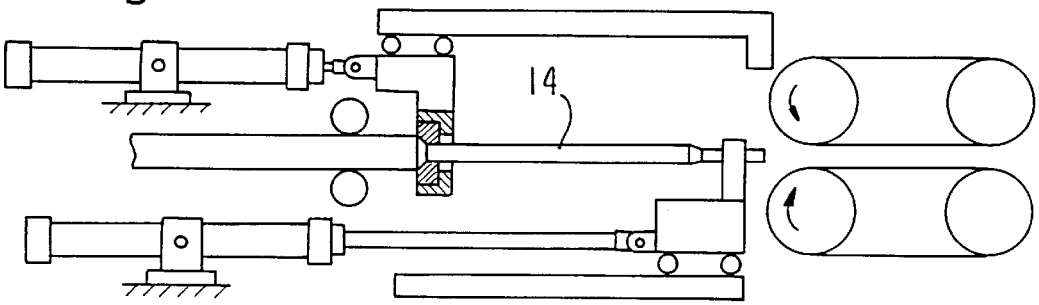
FIG. 2 depicts the apparatus of FIG. 1 showing the gripper carriage and gripper positioned near the drawing unit and a reduced diameter starting portion of the tube formed as the tube is drawn through the drawing ring.

Referring first to FIG. 1, the first drive 4 and drawing ring holder 1 are deployed in an initial or starting position at a maximum distance L from the drawing unit 5. In a preferred embodiment, the displacement length L corresponds at least to the clamping length L1 of the revolving chains 6 of the drawing unit 5. The second drive 8 and gripper carriage 9 are similarly deployed in a starting position, i.e. maximally displaced from the drawing unit 5. The gripper 10 may be selectively mechanically opened and closed to grasp and release the drawing point 12 of the tube 11. The gripper 10 is preferably positioned between the drawing ring holder 2 and the drawing unit 5 when viewed in the drawing direction.

The tube 11, provided with its drawing point 12, is fed into the drawing ring 2, assisted by the driving rollers 13, until the drawing point 12 projects out of the drawing ring 2 on the side facing the drawing unit 5 (see, e.g. FIG. 1). The projecting end of the drawing point 12 is gripped by the gripper 10 while, at the same time, the gripper carriage 9 is set in motion in the drawing direction by drive 8 as indicated by the arrow A. The gripper 10 and driving rollers 13 cause the tube 11 to move along the drawing axis and in the drawing direction thereby forming a reduced diameter starting portion 14 (FIG. 2) as the tube 11 passes through the drawing ring 2—the reduced diameter starting portion 14 having a length approximately equal to the maximum displacement distance L and clamping length L1. Once the tube 11 is thusly drawn through the drawing ring 2, the gripper carriage 9 comes to rest as shown in FIG. 2.

Figure 3:
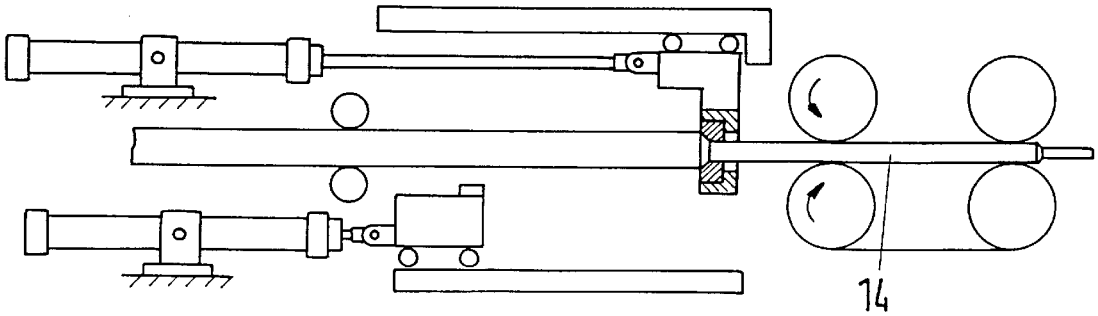
FIG. 3 depicts the apparatus of FIG. 1 showing the drawing ring and drawing ring holder positioned near the drawing unit with the reduced diameter starting portion of the tube being fed into the drawing unit and the gripper carriage returned to its starting position.

The gripper 10 may then be opened, i.e. the drawing point 12 of the tube 11 released, and swiveled out of the drawing axis and away from the tube 11, thereby permitting the gripper carriage 9 to be moved back into its starting position, as shown in FIG. 3. At the same time, the drive 4 and driving rollers 13 cause the drawing ring holder 1 to move in the drawing direction. In so doing, the reduced diameter starting portion 14 of the tube 11 is introduced between the revolving chains 6 of the drawing unit 5 as shown in FIG. 3. The chains 6 continue to draw the tube 11 into the drawing unit 5, ultimately replacing the drawing movement of the drawing ring holder 1 and driving rollers 13. The drawing ring holder 1 is then advantageously caused to move back into its starting position (as shown in FIG. 1) during the continuous drawing process and is ready to repeat the above-described process.

Thus, while there have shown and described and pointed out fundamental novel features of the invention as applied to preferred embodiments thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. It is the intention, therefore, to be limited only as indicated by the scope of the claims appended hereto.

What is claimed is:

1. An apparatus for feeding a generally tubular workpiece having an outer circumference and a drawing point formed at an end thereof into a drawing unit of a continuous drawing machine, the drawing unit having revolving chains and defining a clamping length and being configured for grasping the outer circumference of the workpiece and continuously drawing the workpiece in a drawing direction and along a drawing axis, said apparatus comprising:

a drawing ring holder having a drawing ring mounted therein, said drawing ring holder being selectively moveable along a first path in the drawing direction and opposite thereto, said selective movement of said drawing ring holder defining a movement path having a displacement approximately equal to the clamping length of the drawing unit;

a gripper carriage having a gripper arranged thereon, said gripper being selectively mechanically openable and closable and being configured for gripping the drawing point of the workpiece and for guiding the drawing point into the drawing unit, said gripper carriage being selectively driveable between said drawing ring holder and the drawing unit in the drawing direction along a substantially linear second path that is parallel with and independent from said first path, said gripper being selectively removable from the drawing axis; and two driving rollers located on the side of said drawing ring remote from the drawing unit, said rollers being configured for clamping the workpiece therebetween and moving the workpiece in the drawing direction.

2. The apparatus of claim 1, further comprising:

a first drive connected to said drawing ring holder for selectively moving said drawing ring holder along said first path in the drawing direction and opposite thereto; and a second drive connected to said gripper carriage for selectively moving said gripper carriage along said second path in the drawing direction;

said first and second drives being secured at separate locations remote from said respective drawing ring holder and gripper carriage, said drives being in substantial parallel alignment with the workpiece.

3. The apparatus of claim 2, wherein said first and second drives are configured as piston-cylinder units.

4. The apparatus of claim 1, further comprising:

a first guide path extending parallel to the drawing direction, said drawing ring holder being selectively moveable along said first guide path; and a second guide path extending parallel to the drawing direction, said gripper carriage being selectively moveable along said second guide path.

5. A method of feeding a generally tubular workpiece into a drawing unit having revolving chains and defining a clamping length, the workpiece having an outer circumference and a drawing point formed at an end thereof, the drawing unit being configured for grasping the workpiece at the outer circumference of the workpiece and continuously drawing the workpiece in a drawing direction along a drawing axis, said method comprising the steps of:

(a) positioning a drawing ring holder having a drawing ring mounted therein in an initial position at a distance from the drawing unit equal to the clamping length of the revolving chains;

(b) positioning a gripper carriage having a gripper arranged thereon in an initial position between the drawing ring and drawing unit in the drawing direction;

(c) feeding the drawing point of the workpiece through the drawing ring using drive rollers;

(d) closing the gripper on the drawing point thereby gripping the drawing point;

(e) forming a reduced diameter starting portion of the workpiece by moving the gripper in the drawing direction thereby drawing the workpiece through the drawing ring;

(f) opening the gripper and swiveling the gripper away from the drawing axis;

(g) feeding a portion of the reduced diameter starting portion into the drawing unit by moving the drawing ring holder, drawing ring and workpiece toward the drawing unit, the workpiece being carried in the drawing direction by the drawing ring holder and the drive rollers; and (h) drawing the workpiece into the drawing unit using the revolving chains.

6. The method of claim 5, further comprising the steps of:

moving the gripper carriage to its initial position prior to drawing the workpiece into the drawing unit; and moving the drawing ring holder to its initial position while the workpiece is being drawn through the drawing unit.

7. An apparatus for feeding a generally tubular workpiece having an outer circumference and a drawing point formed at an end thereof into a drawing unit of a continuous drawing machine, the drawing unit having revolving chains and defining a clamping length and being configured for grasping the outer circumference of the workpiece and continuously drawing the workpiece in a drawing direction and along a drawing axis, said apparatus comprising:

means for positioning a drawing ring holder having a drawing ring mounted therein in an initial position at a distance from the drawing unit equal to the clamping length of the revolving chains;

means for positioning a gripper carriage having a gripper arranged thereon in an initial position between the drawing ring and drawing unit in the drawing direction;

means for feeding the drawing point of the workpiece through the drawing ring using drive rollers;

means for closing the gripper on the drawing point thereby gripping the drawing point;

means for forming a reduced diameter starting portion of the workpiece by moving the gripper in the drawing direction thereby drawing the workpiece through the drawing ring;

means for opening the gripper and swiveling the gripper away from the drawing axis;

means for feeding a portion of the reduced diameter starting portion into the drawing unit by moving the drawing ring holder, drawing ring and workpiece toward the drawing unit, the workpiece being carried in the drawing direction by the drawing ring holder and the drive rollers; and means for drawing the workpiece into the drawing unit using the revolving chains.

* * * * *